United States Patent [19]

Poldervaart et al.

[11] Patent Number: 5,052,322

[45] Date of Patent: Oct. 1, 1991

[54] SHIP WITH MOORING MEANS

[75] Inventors: Leendert Poldervaart; Michael Stambouzos, both of La Turbie, France

[73] Assignee: Single Buoy Moorings Inc., Marly, Switzerland

[21] Appl. No.: 555,810

[22] Filed: Jul. 23, 1990

Related U.S. Application Data

[63] Continuation of Ser. No. 319,317, Mar. 6, 1989, abandoned.

[30] Foreign Application Priority Data

Apr. 19, 1988 [NL] Netherlands ..... 8801007

[51] Int. Cl.[5] ..... B63B 21/50

[52] U.S. Cl. ..... 114/230; 441/5

[58] Field of Search ..... 114/230, 264, 267; 441/3-5

[56] References Cited

U.S. PATENT DOCUMENTS

| | | | |
|---|---|---|---|
| 3,440,671 | 4/1969 | Smulders | 114/230 |
| 3,525,312 | 8/1970 | Beck | 441/5 |
| 3,601,075 | 8/1971 | Deslierres | 441/5 |
| 3,620,181 | 11/1971 | Naczuowski | 441/5 |
| 4,604,961 | 8/1986 | Ortloff | 441/5 |
| 4,660,494 | 4/1987 | Dore | 114/230 |
| 4,698,038 | 6/1987 | Key | 441/5 |
| 4,701,143 | 10/1987 | Key | 441/5 |
| 4,765,378 | 8/1988 | Engelskirchen | 441/5 |

FOREIGN PATENT DOCUMENTS

| | | |
|---|---|---|
| 0228966 | 7/1987 | European Pat. Off. . |
| 1447413 | 8/1976 | United Kingdom . |
| 2150517 | 7/1985 | United Kingdom . |

*Primary Examiner*—Joseph F. Peters, Jr.
*Assistant Examiner*—Clifford T. Bartz
*Attorney, Agent, or Firm*—Young & Thompson

[57] ABSTRACT

Mooring means of a ship, comprising a tube rotatably supported at its top-end inside the ship (1) by means of an axial- or axial/radial bearing (8,9).

The outer ring (8) of said bearing being fixed to a rigid ring (7), which does not follow deformations of the hull of the ship.

4 Claims, 1 Drawing Sheet

SHIP WITH MOORING MEANS

This application is a continuation of application Ser. No. 319,317, filed Mar. 6, 1989 now abandoned.

The invention relates to a ship with mooring means, comprising a tube which is fastened rotatably about a vertical axis to the ship by means of a bearing structure which can absorb axial and radial forces, such as a combined axial/radial bearing, of which bearing structure at least the part absorbing the axial forces is at the top end of the tube with the outer ring of said bearing fastened to a support of the ship, and said tube being provided at its bottom end with means for fastening anchor chains or cables.

Such a ship is known from the published Dutch Patent Application 8303279, to which U.S. Pat. No. 4,660,494 corresponds.

In the case of this known ship the rotary tube is supported in a top and bottom carrier projecting beyond the bow of the ship, the top end of the rotary tube being fastened to the inner ring of an axial/radial bearing whose outer ring is fastened to the bearing structure of the ship which projects beyond the bow of the ship. The rotary tube is supported by a radial bearing near the bottom end.

These bearings are made with great precision and make it possible for the ship to turn with minimal resistance round the tube fixed by means of anchor chains. They are, however, located at a place which is disadvantageous because the bow of the ship can be subjected to powerful movements and wave forces.

It is known per se from U.S. Pat. No. 3,440,671 to make provision in the hull of the ship for a cylindrical hollow chamber, and to place therein a tubular element which has buoyancy, is provided with means for fixing anchor chains, and is provided with sets of wheels fitted at intervals along the periphery, permitting a turning of ship and tubular element relative to each other. This mutual support of ship and tube also permits the relative turning even if as a result of the movements of the ship deformations of the walls of the cylindrical tube occur. This cylindrical tube becomes deformed to an oval shape in certain load conditions. With self-adjusting sets of wheels and sufficient play this is permissible.

If, however, one wishes to use a precisely made axial/radial bearing working with considerably less friction, or the combination of an axial bearing with a radial bearing at points lying apart, as known from the earlier-mentioned U.S. Pat. No. 4,660,494, then this is not possible because the axial/radial bearing is then also exposed to the deformation occurring and no longer functions at its best.

The object of the invention is then to produce a ship with mooring means of the type mentioned in the preamble, in which the mooring means are better protected, can be a distance away from the bow, and yet are not exposed to the deformations occurring.

This object is achieved according to the invention in that the tube is placed inside the hull of the ship in a chamber which is at least open at the bottom, and the outer ring of the axial bearing or the axial/radial bearing is fixed to a rigid ring, which is in turn fastened to the top end of a fixed tube which encloses the rotary tube with clearance, and which is fastened to the ship some distance away from and below the rigid ring.

Positioning inside the hull, in combination with accurately manufactured bearings, such as an axial/radial bearing now becomes possible according to the invention through the fact that the rigid ring ensures that the axial/radial bearing is not deformed while, where the tube is fixed to the hull of the ship below the rigid ring, it does permit deformations to an oval shape, without these deformations affecting the shape of the rigid ring and thus of the bearing.

On the basis of this principle, the rigid ring can be of any desired design. It is preferably a rigid ring which is designed as a tubular section.

The position of the rigid ring can be above the deck of the ship, but it can also be below it, in fact at any desired level. With the use of an axial/radial bearing, it can be combined with a radial bearing at a lower level, as known from U.S. Pat. No. 4,660,494. This radial bearing can, however, be omitted, depending on the rigidity and height of the rotary tube.

The fixed tube, which must thus permit oval deformation, need not be higher than is necessary to bridge the distance between the rigid ring and the deforming part of the hull. This fixed tube can, however, extend over the entire height of the open chamber and can then, together with the rotary tube, provide space for the radial bearing which is known per se, and which is located near the bottom end of the rotary tube.

The invention will now be explained in greater detail with reference to the drawings.

Figure 1:
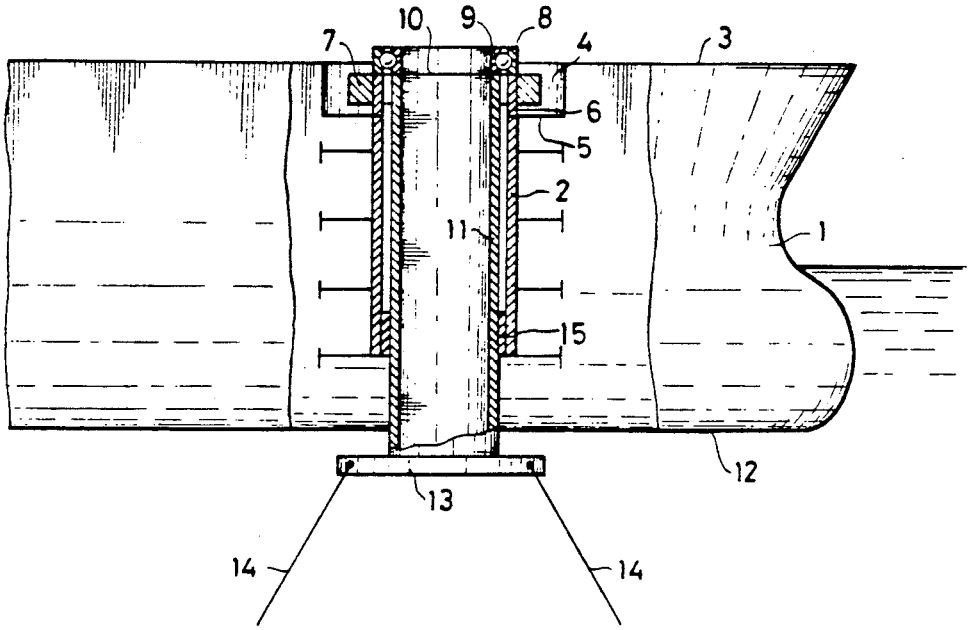
FIG. 1 shows schematically in cross section a first embodiment of the ship according to the invention.

The ship 1 shown in FIG. 1 is provided at a distance from the bow with a cylindrical tube 2, forming a hollow chamber which runs over the whole height of the ship.

The deck 3 has a recessed part 4, the bottom of which is indicated by 5.

A tube 6 runs upwards from the bottom 5, and said tube 6 can be an extension of the tube 2. This tube 6 bears at its top end a rigid ring 7, designed as a box section running round the fixed tube 6.

The axial/radial bearing comprises an outer ring 8 which is fixed in a manner known per se to the rigid ring 7, and an inner ring 9 which is fixed in a manner known per se to the top end 10 of a rotary tube 11, which is provided, below the bottom 12 of the ship, with means 13 for fastening thereto anchor chains 14.

At 15 there can be a radial bearing which absorbs transverse forces, but permits lengthwise displacements.

The recessed part 4 shown can also be at an even lower level, which lessens the need for the radial bearing 15.

Figure 2:
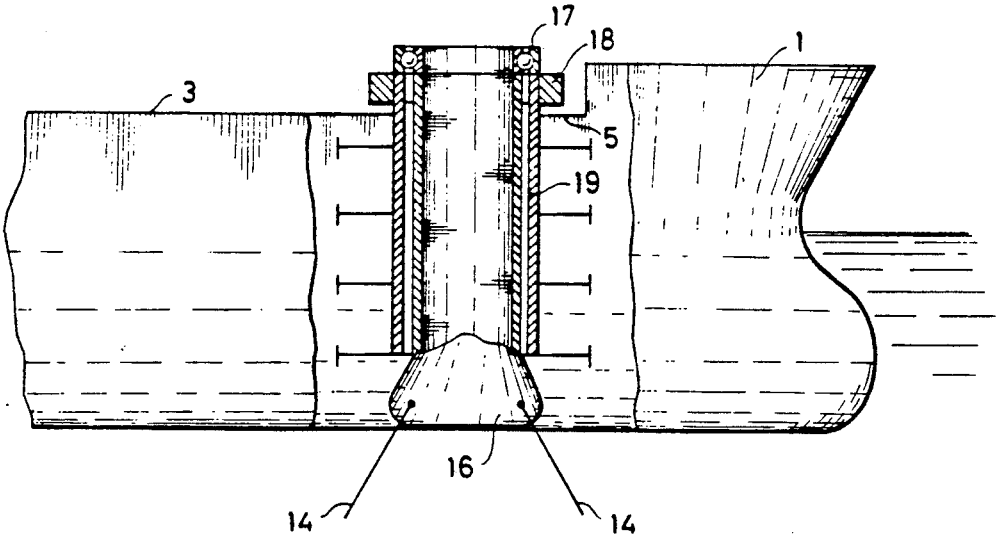
FIG. 2 shows schematically a second embodiment.

In the embodiment of FIG. 2 the rotary tube 16 is mounted in the ship 1 by means of a single axial/radial bearing 17, which is fastened in the same way as shown in FIG. 1 by the inner ring to the rotary tube 16 and by the outer ring to the rigid ring 18, which is itself fastened to the outer tube 19, which is fixed in the hull of the ship at a lower level, i.e. lower than the rigid ring 18.

The radial bearing is omitted here. The main difference from the embodiment of FIG. 1 is that the rigid ring 18 and the axial/radial bearing 17 are above the deck 3 of the ship.

In the case of both embodiments, when the ship exposed to bending through the wave movement deforms at the hollow chamber, viewed in horizontal sections, to such an extent that a cylindrical section becomes an oval section, this deformation, for example, at the level of the bottom 5 of the recess, gradually passes into the non-deformable part which is surrounded by the rigid ring.

We claim:

1. Ship with mooring means, comprising a rotatable tube (11), which is fastened rotatably to the ship (1) about a vertical axis which is concentric to the rotatable tube (11) by means of an axial/radial bearing structure (8, 9) which can absorb axial and radial forces of which bearing structure at least the part absorbing the axial forces is at the top end of the rotatable tube (11), and said rotatable tube (11) being provided at its bottom end with means (13) for fastening anchor chains or cable (14), wherein the rotatable tube (11) is placed inside the hull of the ship (1) in a fixed tube (2) which is at least open at the bottom, and the outer ring (8) of the axial/-radial bearing (8, 9) is fixed to a rigid ring (7), which is in turn fastened only to the top end of said fixed tube (2) which fixed tube (2) encloses the rotatable tube (11) with clearance, said fixed tube (2) being fastened to the ship only some distance away from and below the rigid ring (7) and being free from fixed securement to the ship above the rigid ring.

2. Ship according to claim 1, wherein the rigid ring (7) is a tubular section.

3. Ship according to claim 1, wherein said rigid ring (7) is disposed in and spaced from a recessed part (4) of a deck (3) of the ship.

4. Ship according to claim 1, wherein said rigid ring (7) is spaced above a deck (3) of the ship.

* * * * *